US005630513A

United States Patent [19]

Frykhult

[11] Patent Number: 5,630,513

[45] Date of Patent: May 20, 1997

[54] APPARATUS FOR FRACTIONATING SUSPENSIONS

[75] Inventor: Siri V. Frykhult, Huddinge, Sweden

[73] Assignee: Beloit Technologies, Inc., Wilmington, Del.

[21] Appl. No.: 600,953

[22] PCT Filed: Aug. 23, 1994

[86] PCT No.: PCT/SE94/00768

§ 371 Date: Feb. 22, 1996

§ 102(e) Date: Feb. 22, 1996

[87] PCT Pub. No.: WO95/06160

PCT Pub. Date: Mar. 2, 1995

[30] Foreign Application Priority Data

Aug. 27, 1993 [SE] Sweden ..... 9302781

[51] Int. Cl.[6] ..... B07B 1/22

[52] U.S. Cl. ..... 209/270; 209/290

[58] Field of Search ..... 209/270, 290, 209/291, 289, 906

[56] References Cited

U.S. PATENT DOCUMENTS

| | | | |
|---|---|---|---|
| 261,653 | 7/1882 | Bayley | 209/290 X |
| 2,274,891 | 3/1942 | Dysthe | 209/270 X |
| 3,113,733 | 12/1963 | Carlson | 209/270 X |
| 3,145,164 | 8/1964 | Jonkman | 209/270 X |
| 3,392,828 | 7/1968 | Muller | 209/270 X |
| 4,075,104 | 2/1978 | Ringel . | |

FOREIGN PATENT DOCUMENTS

| | | | |
|---|---|---|---|
| 1505599 | 9/1989 | U.S.S.R. | 209/270 |
| 1558508 | 4/1990 | U.S.S.R. | 209/270 |
| WO90/06396 | 6/1990 | WIPO . | |
| WO91/12065 | 8/1991 | WIPO . | |

*Primary Examiner*—D. Glenn Dayoan
*Attorney, Agent, or Firm*—Young & Thompson

[57] ABSTRACT

An apparatus for fractionating suspensions includes a tubular strainer (1) rotatable about a horizontal axis, and a spray device (5,7) arranged to spray the suspension against the strainer. The strainer has at least two strainer sections (2) spaced from each other and disposed axially in series along the tubular strainer. The spray device has at least one row of spray nozzles (7) extending axially along the tubular strainer and adapted to spray the suspension onto the strainer from above the strainer.

8 Claims, 5 Drawing Sheets

APPARATUS FOR FRACTIONATING SUSPENSIONS

BACKGROUND OF THE INVENTION

The present invention relates to an apparatus for fractionating suspensions including a tubular body having a centre and a circumferential strainer, and drive means arranged to turn the tubular body such that the strainer is turned at least intermittently about an axis extending through the centre of and substantially axially along the tubular body. Spray means is arranged to spray a suspension to be fractionated against the strainer such that a fine fraction of the suspension penetrates the strainer and a coarse fraction of the suspension is rejected by the strainer. Fine fraction discharge means is provided for discharging the fine fraction from the apparatus.

This type of spray fractionating apparatus is known to have a large flow capacity, compared with other conventional types of fractionating apparatus. However, a problem of the spray fractionating apparatus is that some of the coarse particles developed on the strainer can block the strainer holes and thereby prevent fine fraction from penetrating the strainer until said coarse particles have been removed from the strainer.

OBJECT OF THE INVENTION

The object of the present invention is to provide a simple spray fractionating apparatus having an improved coarse particles removal capability.

This object is fulfilled by means of a spray fractionating apparatus of the type defined above, which is characterized in that the tubular body is positioned such that said axis extends substantially horizontally; the strainer comprises at least two strainer sections spaced from each other and disposed axially in series along the tubular body; and the spray means comprises at least one row of spray nozzles extending axially along the tubular body and adapted to spray the suspension onto the strainer sections from above the tubular body.

During operation, the developed coarse fraction leaves the strainer by flowing circumferentially between the strainer sections without blocking the strainer holes to be sprayed upon with suspension.

According to a preferred embodiment of the invention, the tubular body forms an annular groove between the strainer sections. The groove has less transversal extension than the strainer sections and serves to receive coarse fraction.

To aid the coarse fraction to flow into said groove, each strainer section may slope as seen in a longitudinal section through the top of the tubular body. In case the strainer comprises more than two strainer sections, it is preferred that at least each of the intermediate strainer sections slopes from a top point of the strainer section in two opposite axial directions of the tubular body, as seen in said longitudinal section.

An advantageous use of the apparatus of the invention is the combination of it with a dewatering device such that the developed coarse fraction of the suspension is directly conveyed by gravity to the dewatering device.

The apparatus of the invention is particularly suited for fractionating fibre pulp suspensions.

BRIEF DESCRIPTION OF THE DRAWINGS

The invention is explained below in more detail by way of example with reference to the accompanying drawings, in which.

DETAILED DESCRIPTION OF THE PREFERRED EMBODIMENT

Figure 1:
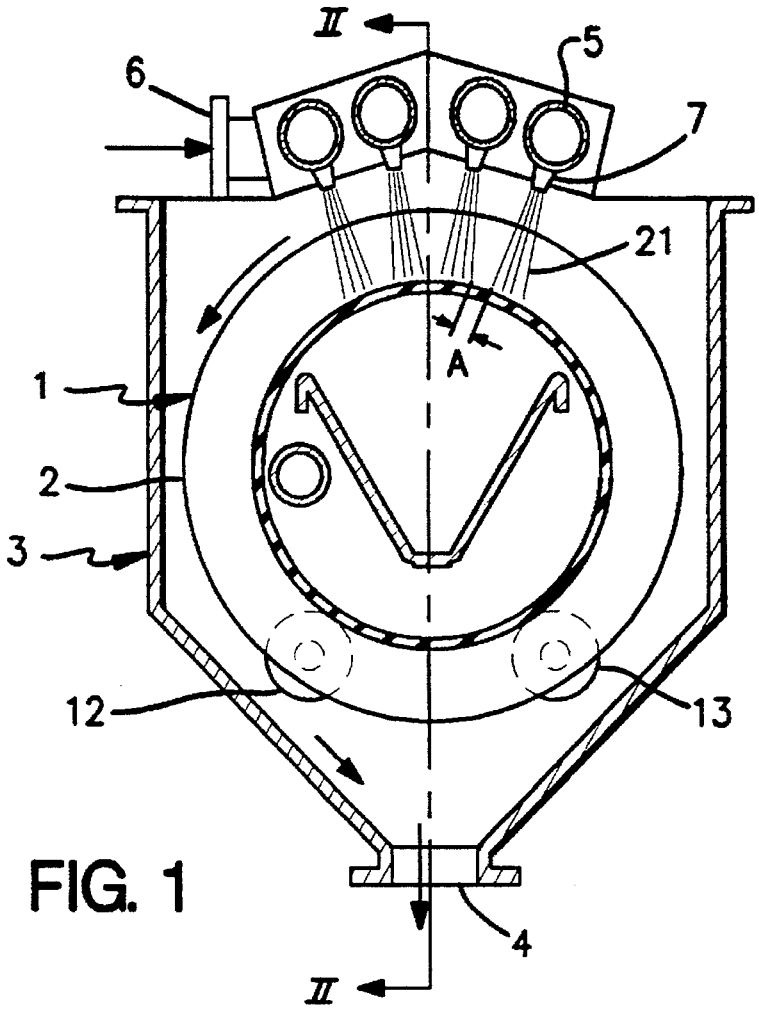
FIG. 1 is a cross-sectional view of a preferred embodiment of an apparatus according to the invention.
Figure 2:
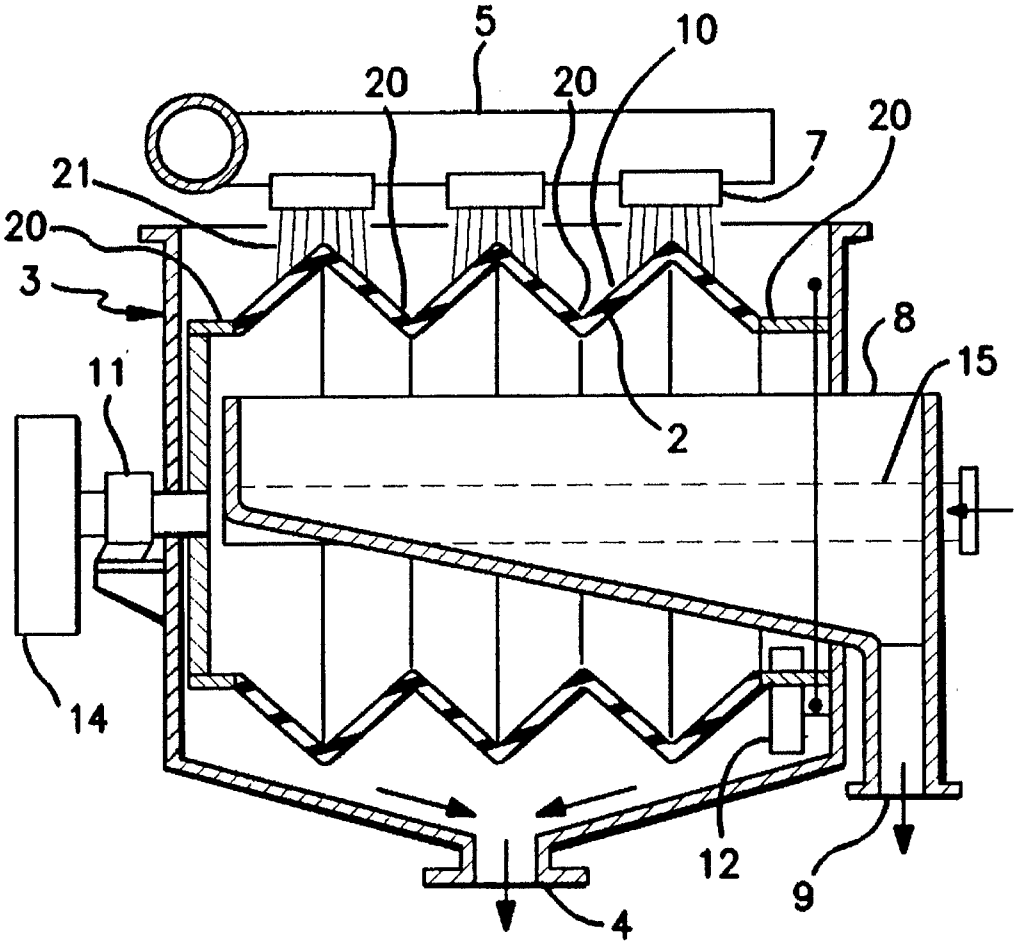
FIG. 2 is a longitudinal view along line II—II of the FIG. 1.

The embodiment of the apparatus of the invention shown in FIGS. 1 and 2 comprises a tubular body 1 having a centre and three circumferential strainer sections 2 forming a tubular strainer. The tubular body 1 is rotatable about a horizontal axis in a container 3, which is provided with a coarse fraction outlet 4 at the bottom of the container 3. Four distribution pipes 5 are connected to an inlet pipe 6 for a suspension to be fractionated. Each distribution pipe 5 is provided with three spray nozzles 7 adapted to spray the suspension in the form of jets 21 against the three strainer sections 2, respectively, from above the strainer 1.

Inside the tubular body 1 there is a sloping chute 8 for receiving fine fraction and for conveying received fine fraction by gravity to a fine fraction outlet 9 situated outside the container 3. The tubular body 1 is journaled on the container 3 by means of a bearing 11 and rolls 12 and 13. A drive motor 14 is arranged to rotate the body 1 continously or intermittently. Within the body 1 there is a spray means 15 for cleaning the strainer sections 2.

Figure 3:
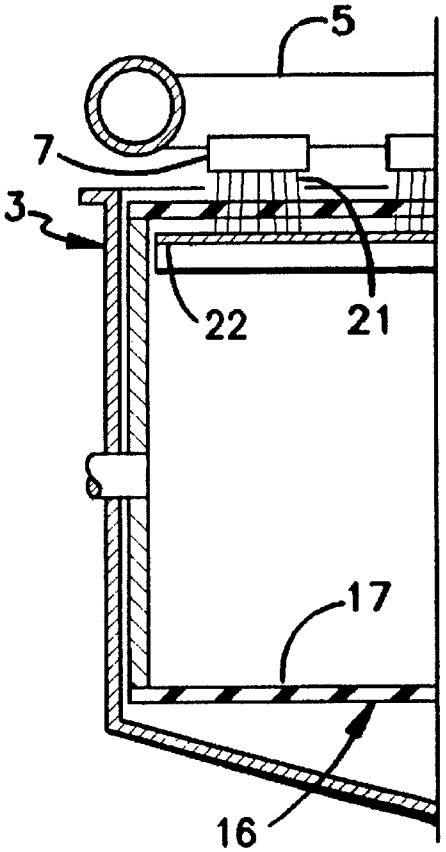
FIG. 3 is a modification shown in part of the embodiment shown in FIG. 2, FIGS. 4 and 5 show two further embodiments of the apparatus of the invention.
Figure 6:
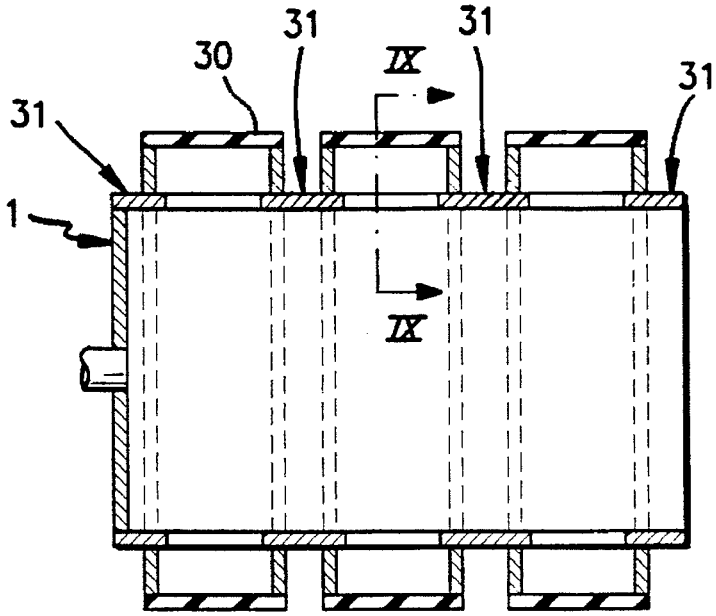
FIGS. 6–8 and 10 are modifications of the strainer of the the embodiment shown in FIG. 2.
Figure 7:
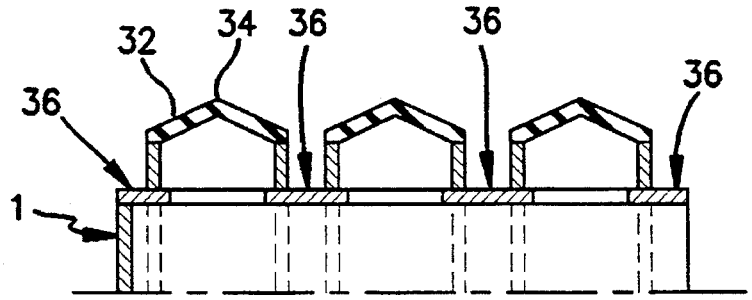
Figure 8:
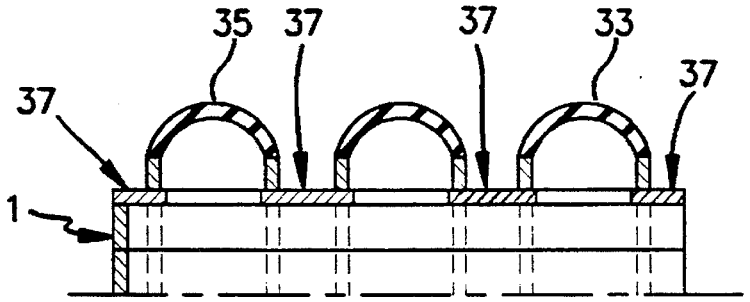
Figure 9:
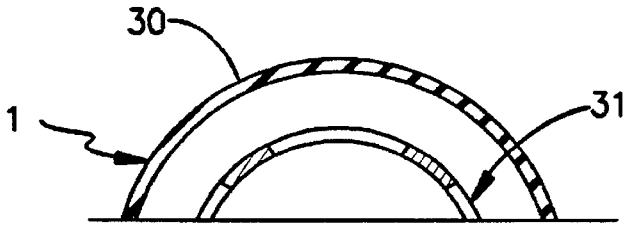
FIG. 9 is a section along line IX—IX of FIG. 6.

Each strainer section 2 is composed by two interconnected truncated conical strainer elements 10, whereby the assembled strainer 1 has a form of a bellows. As an alternative, the strainer sections 2 may be exchanged by cylindrical strainer sections formed on a cylindrical body 16, see FIG. 3. Another alternative is to form each strainer section 30 cylindrical and to provide a groove 31 between adjacent cylindrical and to provide a groove 31 between adjacent cylindrical strainer sections 30, see FIGS. 6 and 9. Yet another alternative is to exchange such cylindrical strainer sections by strainer sections 32, 33, each of which slopes from a top point 34, 35 of the strainer section in two opposite axial directions towards grooves 36, 37, as seen in a longitudinal section through the top of the tubular body, see FIGS. 7 and 8. Each strainer section may slope straight (FIG. 7) or progressively (FIG. 8) from said top point 34, 35.

In operation, a suspension to be fractionated is supplied through the inlet pipe 6 and the distribution pipes 5 to the spray nozzles 7, which spray the suspension onto the strainer sections 2, whereby a fine fraction penetrates the strainer sections 2 and is received by the chute 8 and is discharged from the apparatus via the outlet 9. For each revolution of the tubular body 1 provided by the drive motor 14, the strainer sections 2 are cleansed by the spray means 15. The body 1 may be rotated intermittently, for instance during a few minutes per hour.

When intermittent rotation of the tubular body 1 is possible to carry out, three advantages are achieved: firstly, less energy is required for rotating the strainer; secondly, less energy is required for pumping the cleansing liquid under high pressure (the spray means 15 is kept inoperative during standstill of the body 1); and thirdly, the dilution of the coarse fraction (by cleansing liquid) will be substantially reduced. During intermittent rotation of the body 1, the developed coarse fraction flows by gravity circumferentially in the grooves 20 to a position in which it drops from the body 1 to the bottom of the container 3.

It is advantageous to provide an impingement plate 22 (see FIG. 3) inside the tubular body 16 close to the strainer sections 17, where jets of fine fraction develop, in particular in the case the body 16 is rotated intermittently. The jets of fine fraction impinge on the plates 22 back against the strainer sections 17 whereby the strainer sections 17 are cleansed to a certain degree. As a result, the intervals between the cleansing operations by means of the spray means 15 can be prolonged.

In case the tubular body is rotated continuously it may be suitable to adjust the spray nozzles 7 such that circumferentially adjacent spray jets 21 are close to each other, that is a distance A between adjacent spray jets 21 is equal to or near zero, see FIG. 1. The circumferentially adjacent spray jets 21 may even operlap each other somewhat.

Figure 4:
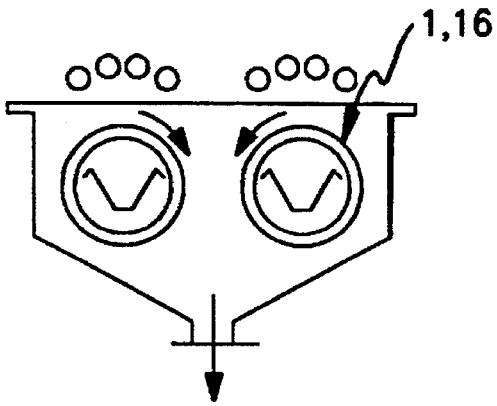
Figure 5:
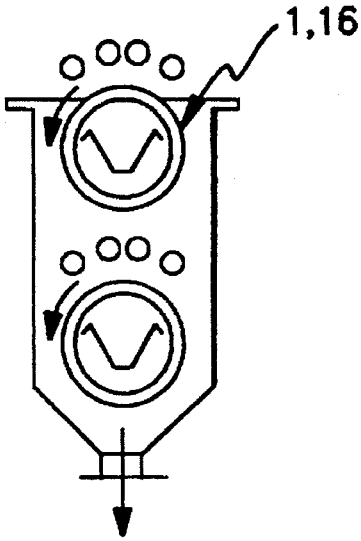

Depending on the required capacity two or more tubular bodies 1,16 may be arranged in the same container, see FIGS. 4 and 5.

The tubular body 1 may have a cylindrical or polygonal cross-section. A square cross-section of the body 1 can be economical in case the body 1 is intermittently turned half a revolution from time to time, for example half a revolution per day. In such a case, the bottom of the grooves between adjacent strainer sections should be cylindrical. When a square tubular body is kept immovable during operation it should be positioned so that a corner of the body is at the top, which enables the developed coarse fraction to flow down along the grooves at opposite sides of the body.

Figure 10:
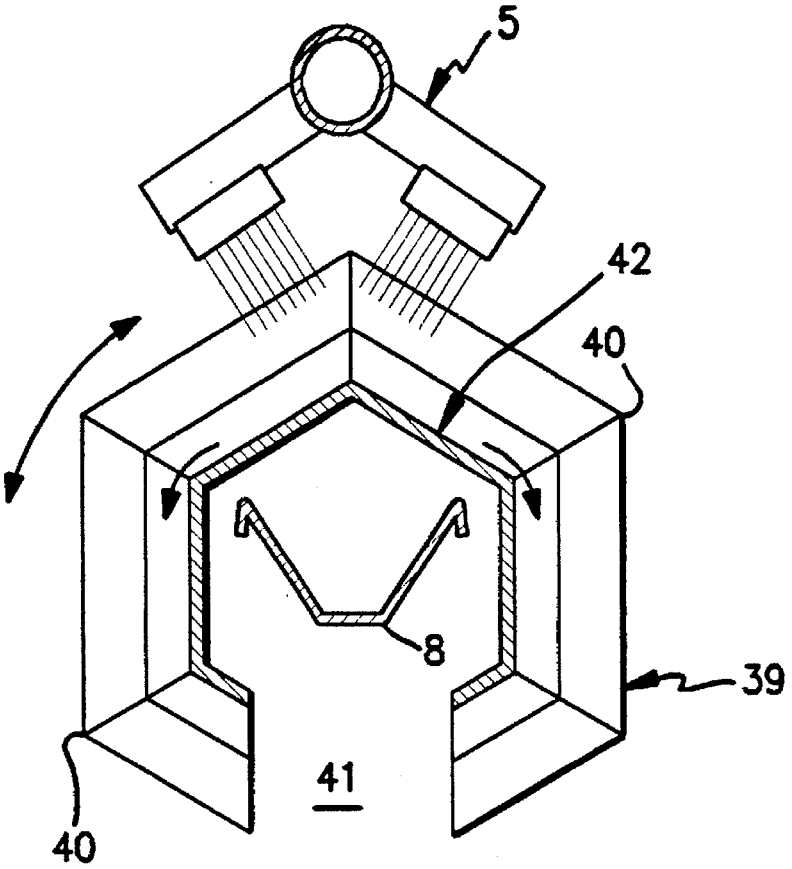
Figure 11:
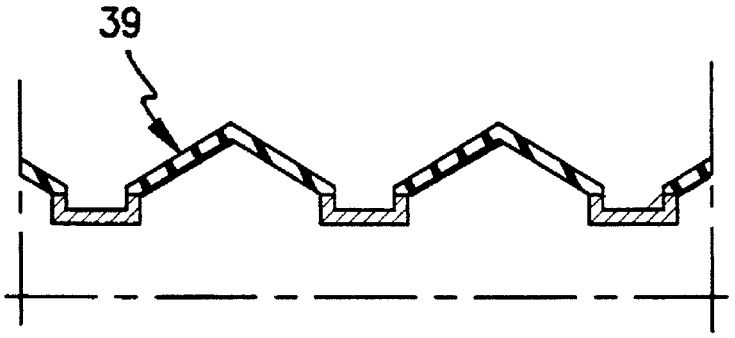
FIG. 11 is a part of a section along line XI—XI of FIG. 10.

In FIGS. 10 and 11 there is shown a tubular body 39 having a cross-section which is substantially hexagonal. A longitudinal bottom portion of the body 39 is removed from the body 39, such that the body 39 has five corners 40 left. The term "tubular" is meant to encompass the above-described type of body 39, which may be defined as a "slitted" tubular body. The removal of said longitudinal portion of the body 39 creates an opening 41 in the body 39. If the opening 41 is larger than the horizontal extension of the chute 8, a strainer section can be removed from the apparatus for services, without need for disassembling any other component, such as the chute 8. Since the body 39 is provided with an opening 41 it is suitable to rotate it back and forth, intermittently or continuously, such that the spray nozzles for suspension do not spray through the opening 41.

Figure 12:
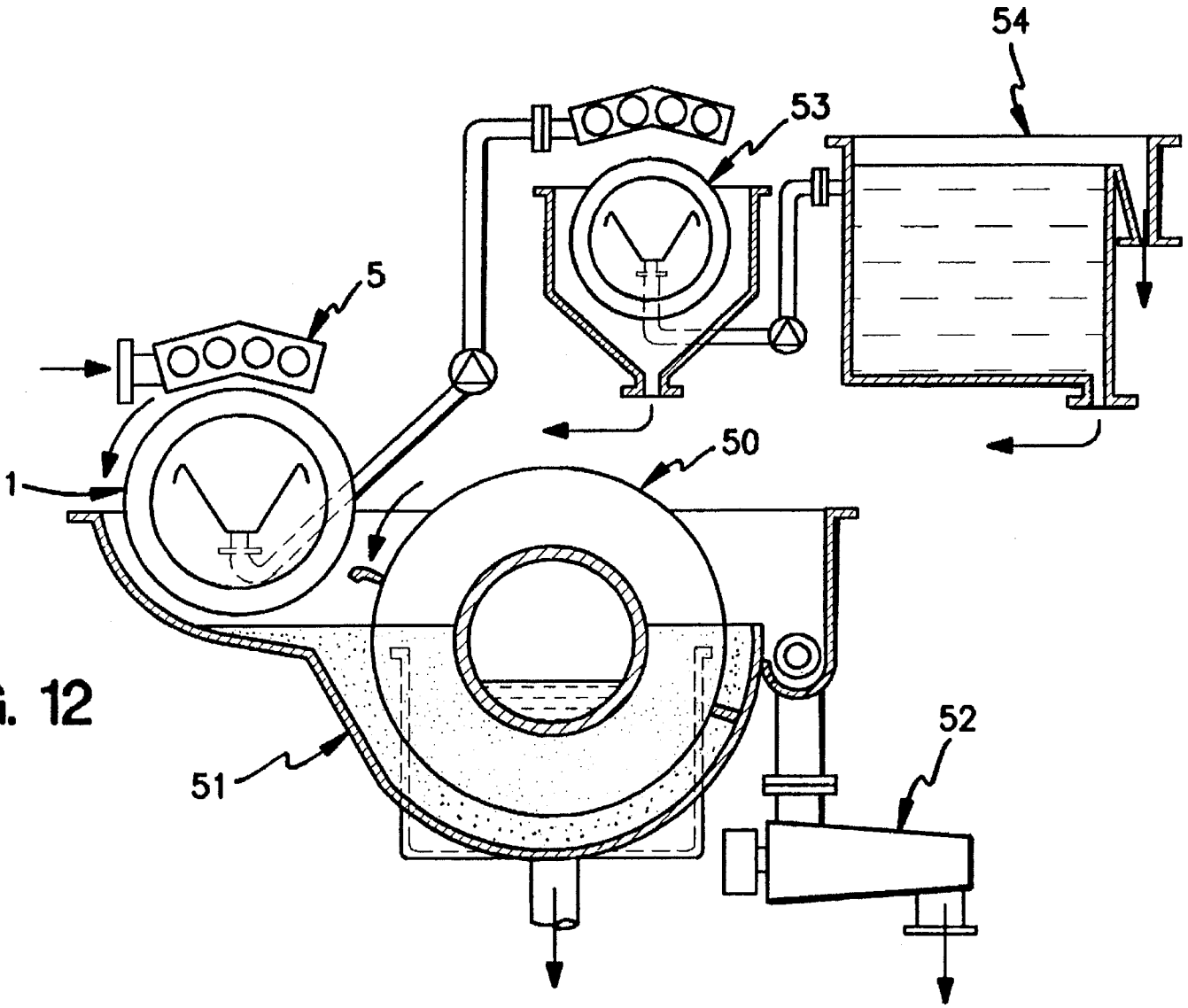
FIG. 12 is a combination of an apparatus of the invention and a dewatering device.

The apparatus of the invention is particularly suited for fractionating fibre pulp suspensions in the pulp and paper making industry. Since the fibre suspensions have to have a low consistency of about 1% solids, in order to be satisfactorily fractionated by the apparatus of the invention, the flows of fibre suspension to be treated will be considerably large. In consequence, there will be a need to dewater the created coarse fraction. An economical arrangement for both fractionating and dewatering operations is shown in FIG 12. The arrangement comprises an apparatus of the invention having a tubular body 1 and distribution pipes 5 for a fibre suspension to be fractionated arranged in a container 51, in which a dewatering device 50 also is arranged. The developed coarse fraction may pour into the container 51 to be dewatered by the dewatering device 50. If there is a need for an extremely high solids consistency of the outgoing suspension, a so-called screw-press 52 may be provided downstream of the dewatering device 50.

In case it is desirable to separate fine particles from water, in order to recirculate the water, a flotation device 54 may be arranged downstream of the fractionating apparatus 1,5 for receiving the fine fraction from the latter.

In certain applications an optimal result can be achieved by arranging two units of the fractionating apparatus in series, i.e. the fine fraction from a primary fractionating apparatus 1,5 is conducted to a secondary fractionating apparatus 53. Then, the fine fraction from the secondary apparatus 53 is supplied to said flotation device 54.

I claim:

1. An apparatus for fractionating suspension, including a tubular body (1,16,39) having a centre and a circumferential strainer (2,17,30,32,33), drive means (14) arranged to turn the tubular body such that the strainer is turned at least intermittently about an axis extending through the centre of and substantially axially along the tubular body, spray means (7) arranged to spray a suspension to be fractionated against the strainer such that a fine fraction of the suspension penetrates the strainer and a coarse fraction of the suspension is rejected by the strainer, and fine fraction discharge means (8,9) for discharging the fine fraction from the apparatus, characterized in that the tubular body (1,16,39) is positioned such that said axis extends substantially horizontally, the strainer comprises at least two strainer sections (2,17, 30,32,33) spaced from each other and disposed axially in series along the tubular body, and the spray means comprises at least one row of spray nozzles (7) extending axially along the tubular body and adapted to spray the suspension onto the strainer sections from above the tubular body.

2. An apparatus according to claim 1, wherein the tubular body (1,39) forms an annular groove (20,31,36,37) between the strainer sections (2,30,32,33), said groove having less transversal extension than the strainer sections.

3. An apparatus according to claim 2, wherein each strainer section (2,32,33) slopes as seen in a longitudinal section through the top of the tubular body (1,39).

4. An apparatus according to claim 3, wherein each strainer section (2,32,33) slopes from a top point (34,35) of the strainer section in two opposite axial directions of the tubular body (1,39), as seen in said longitudinal section.

5. An apparatus according to claim 1, wherein the spray means comprises a plurality of rows of spray nozzles (7) extending axially along the tubular body (1,16,39).

6. An apparatus according to claim 1, wherein the fine fraction discharge means (8,9) is arranged to receive fine fraction penetrating the strainer (2,17,30,32,33,39) and to convey the received fine fraction out of the tubular body (1,16,39).

7. An apparatus according to claim 6, wherein the fine fraction discharge means (8,9) comprises a sloping chute (8) extending within the tubular body (1,16,39) and adapted to convey received fine fraction by gravity from the tubular body.

8. Use of an apparatus according to claim 1, characterized in that the apparatus (1,5) is combined with a dewatering device (50), such that the coarse fraction of the suspension developed in the apparatus is directly conveyed by gravity to the dewatering device.

* * * * *